US011576470B2

(12) United States Patent
Nakatsuka

(10) Patent No.: US 11,576,470 B2
(45) Date of Patent: Feb. 14, 2023

(54) BAND PIECE, BAND AND TIMEPIECE

(71) Applicant: CASIO COMPUTER CO., LTD., Tokyo (JP)

(72) Inventor: Yoshiki Nakatsuka, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 130 days.

(21) Appl. No.: 17/146,868

(22) Filed: Jan. 12, 2021

(65) Prior Publication Data

US 2021/0274893 A1 Sep. 9, 2021

(30) Foreign Application Priority Data

Mar. 9, 2020 (JP) ..... JP2020-039692

(51) Int. Cl.
*A44C 5/10* (2006.01)

(52) U.S. Cl.
CPC ..... *A44C 5/107* (2013.01)

(58) Field of Classification Search
CPC ..... A44C 5/107
See application file for complete search history.

(56) References Cited

U.S. PATENT DOCUMENTS

| | | | | |
|---|---|---|---|---|
| 10,342,303 | B2 * | 7/2019 | Yamakawa | A44C 5/105 |
| 2018/0168293 | A1 * | 6/2018 | Leiggener | A44C 5/107 |

FOREIGN PATENT DOCUMENTS

| | | | | |
|---|---|---|---|---|
| CH | 698936 | B1 * | 12/2009 | A44C 5/107 |
| CH | 711304 | A2 * | 1/2017 | A44C 5/107 |
| CH | 713266 | A2 * | 6/2018 | |
| DE | 2133008 | A1 * | 1/1973 | |
| EP | 576998 | A1 * | 1/1994 | A44C 5/107 |
| JP | S5874814 | U | 5/1983 | |
| JP | S62139306 | U | 9/1987 | |
| JP | H03244404 | A | 10/1991 | |
| JP | 2005034294 | A | 2/2005 | |
| JP | 2006122530 | A | 5/2006 | |
| JP | 2008029803 | A | 2/2008 | |
| JP | 3148398 | U | 2/2009 | |
| JP | 2012065756 | A | 4/2012 | |
| JP | 2014087455 | A | 5/2014 | |
| JP | 2015029806 | A | 2/2015 | |

OTHER PUBLICATIONS

Japanese Office Action (and English language translation thereof) dated Feb. 1, 2022, issued in counterpart Japanese Application No. 2020-039692.

Japanese Office Action (and English language translation thereof) dated Aug. 1, 2022, issued in counterpart Japanese Application No. 2020-039692.

* cited by examiner

*Primary Examiner* — Jack W Lavinder
(74) *Attorney, Agent, or Firm* — Holtz, Holtz & Volek PC

(57) ABSTRACT

A band piece including a first piece, a second piece which covers one of front and back surface sides of the first piece, a pin which connects the first piece and the second piece and connects the band piece and another band piece.

20 Claims, 7 Drawing Sheets

BAND PIECE, BAND AND TIMEPIECE

CROSS-REFERENCE TO RELATED APPLICATION

This application is based upon and claims the benefit of priority from the prior Japanese Patent Application No. 2020-039692, filed Mar. 9, 2020, the entire contents of which are incorporated herein by reference.

BACKGROUND

1. Technical Field

The technical field relates to a band piece that is used for wristwatches, bracelets, handbags, and the like, a band formed by the band piece being plurally connected, and a timepiece equipped with the band.

2. Description of the Related Art

A watch band is known in which each band piece includes a pair of outer pieces made of synthetic resin, an inner piece which is also made of synthetic resin and is arranged between the pair of outer pieces, and side pieces which are made of metal and attached to the outside surfaces of the outer pieces, and is formed by these pieces being connected in a substantially Y-shape by a pin component, as described in Japanese Utility Model Registration No. 3148398.

SUMMARY

In accordance with one embodiment, there is provided a band piece comprising: a first piece; a second piece which covers one of front and back surface sides of the first piece; a pin which connects the first piece and the second piece and connects the band piece and another band piece.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

A wristwatch of an embodiment will hereinafter be described with reference to FIG. 1 to FIG. 7.

Figure 1:
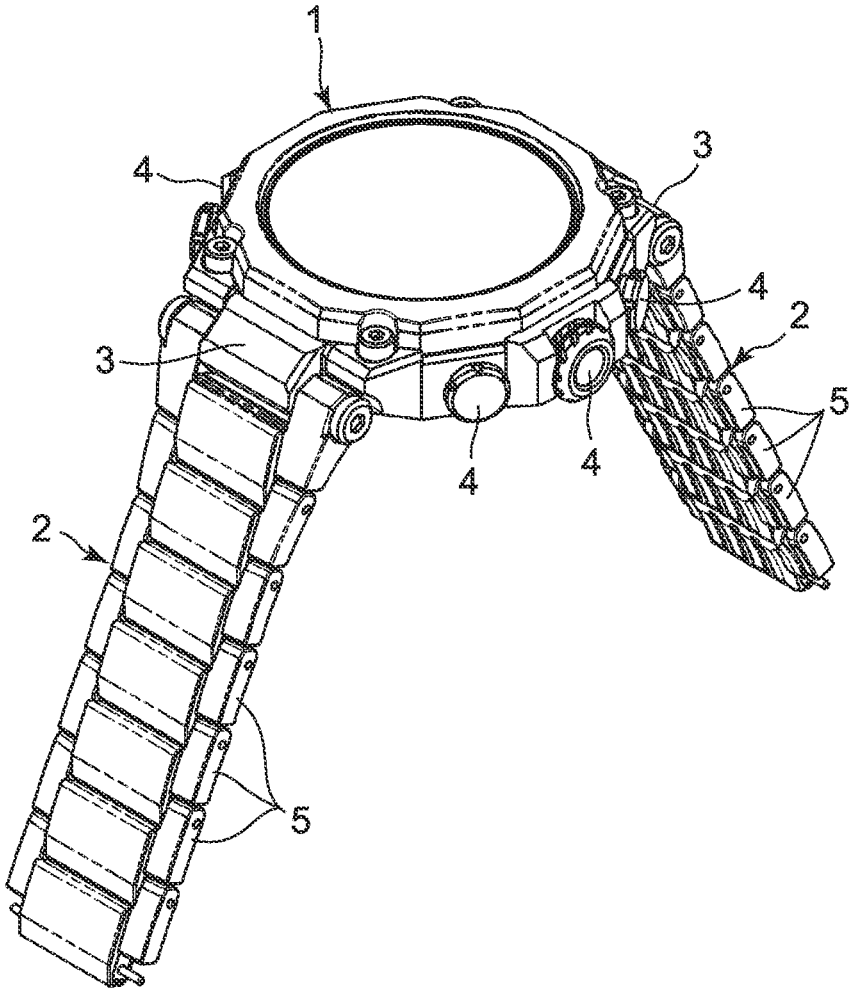
FIG. 1 is a perspective view showing a wristwatch of an embodiment.

This wristwatch includes a wristwatch case 1, as shown in FIG. 1. On the 12 o'clock side and 6 o'clock side of the wristwatch case 1, band attachment sections 3 to which watch bands 2 are attached are provided, respectively. Also, on the 2 o'clock side, 3 o'clock side, 4 o'clock side, 8 o'clock side, and 10 o'clock side of the wristwatch case 1, switch devices 4 are provided.

Figure 2A:
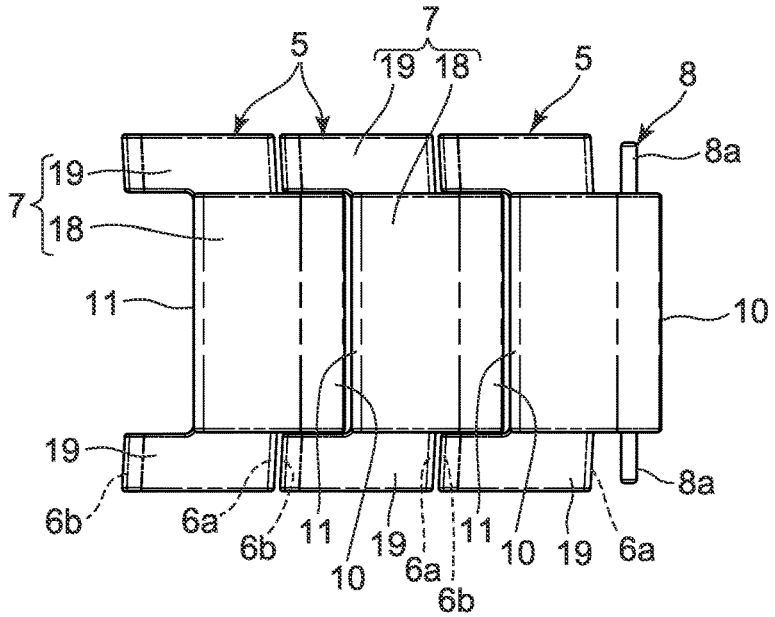
FIG. 2A is an enlarged front view showing a portion of a watch band of the wristwatch shown in FIG. 1.
Figure 2B:
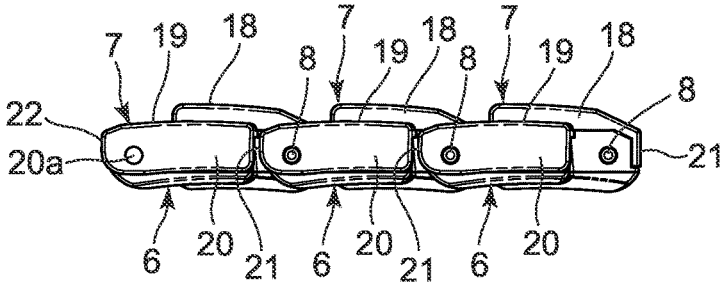
FIG. 2B is an enlarged side view showing the portion of the watch band of the wristwatch shown in FIG. 1.
Figure 2C:
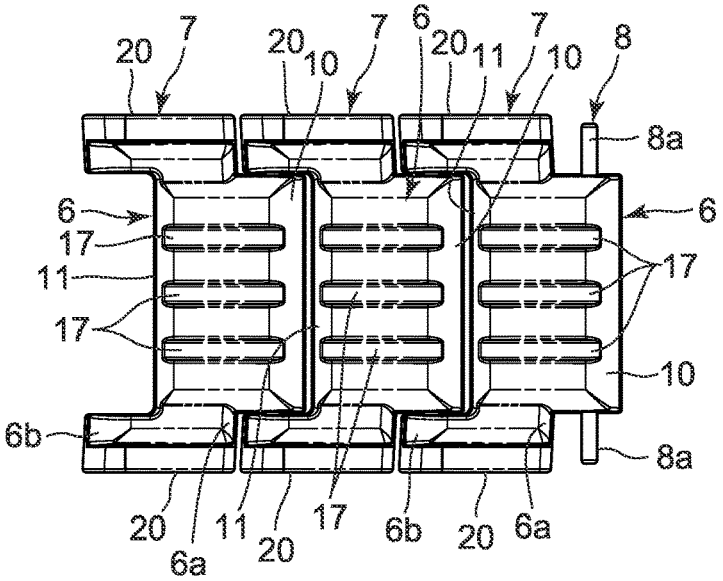
FIG. 2C is an enlarged back view showing the portion of the watch band of the wristwatch shown in FIG. 1.

Each watch band 2 has a structure where a plurality of band pieces 5 have been serially connected, as shown in FIG. 1 to FIG. 2C. Each band piece 5 includes a first piece 6 made of synthetic resin, and a second piece 7 which is made of metal and covers one surface side of the first piece 6, or more specifically, the front surface side (upper surface side in FIG. 4) of the first piece 6 such that the other surface side of the first piece 6, or more specifically, the back surface side (lower surface side in FIG. 4) of the first piece 6 is exposed, and is formed by these pieces being overlapped with each other and connected by a stick-shaped pin component 8, as shown in FIG. 3A to FIG. 5.

The first piece 6 includes a projection section 10 provided projecting on one end portion 6*a* in a piece connection direction, and a connection recess section 11 provided on the other end portion 6*b* on the side opposite to the one end portion 6*a* such that the projection section 10 of an adjacent band piece 5 can be arranged, as shown in FIG. 3A to FIG. 5. This first piece 6 is made of a synthetic resin such as urethane resin. In a center area thereof, that is, in an area between the projection section 10 and the connection recess section 11, a hollowed-out recess section 12 is provided to be exposed to the front surface side.

This hollowed-out recess section 12 is a recessed portion formed for material saving, that is, the saving of the above-described synthetic resin material such as urethane resin. In this hollowed-out recess section 12, two support pillars 13 are provided protruding from the front surface, as shown in FIG. 3A, FIG. 3B, FIG. 3C and FIG. 4. On a leading end portion of the projection section 10 of the first piece 6, an inclined surface 10*a* is provided inclining toward the back surface side from the front surface side. Also, in a middle portion of the projection section 10 in a direction perpendicular to the piece connection direction, an attachment recess section 14 where a connection fixing section 23 of the second piece 7 described later is arranged is provided to be exposed toward the front surface side and the leading end side.

Also, in the projection section 10 of the first piece 6, pin attachment holes 15 where the pin component 8 is inserted and attached are coaxially provided corresponding to each other and located to the sides of the attachment recess section 14 in the direction perpendicular to the piece connection direction, as shown in FIG. 3A to FIG. 5. In this embodiment, the pin component 8 is formed such that its outer diameter is substantially the same as the inner diameter of each pin attachment hole 15, and its length in the axial direction is substantially the same as the length of the band piece 5 in the direction perpendicular to the piece connection direction, and corresponds to the projection section 10 and the connection recess section 11 of the first piece 6.

As a result, the pin component 8 is structured such that, when it is inserted into the pin attachment holes 15 of the projection section 10 of the first piece 6 which are positioned to the sides of the attachment recess section 14, end portions 8*a* on both sides of the pin component 8 protrude from the sides of the projection section 10 in the direction perpendicular to the piece connection direction via the pin attachment holes 15, as shown in FIG. 2A and FIG. 2C.

Also, in side portions 11*a* of the connection recess section 11 of the first piece 6, first connection holes 16 where the end portions 8*a* of a pin component 8 protruding from the sides of the projection section 10 of the first piece 6 of the adjacent band piece 5 are inserted and attached are provided coaxially corresponding to pin attachment holes 15 in the projection section 10 of the adjacent band piece 5, as shown in FIG. 3A to FIG. 5. On the back surface of the first piece 6, a plurality of groove sections 17 for sweat drainage is provided along the piece connection direction.

On the other hand, the second piece 7 is made of a metal such as stainless steel or titanium alloy, and covers the first piece 6 in a manner to expose one of the front and back surface sides of the first piece 6 (the back surface side in the present embodiment), as shown in FIG. 3A to FIG. 5. That is, this second piece 7 includes a first front surface protection section 18 which covers and protects a portion of the front surface of the first piece 6 from the projection section 10 to the connection recess section 11, and second front surface protection sections 19 which cover and protect portions of the front surface of the first piece 6 corresponding to the side portions 11*a* located on the sides of the connection recess section 11 in the direction perpendicular to the piece connection direction, from the one end portion 6*a* to the other end portion 6*b*.

Figure 3A:
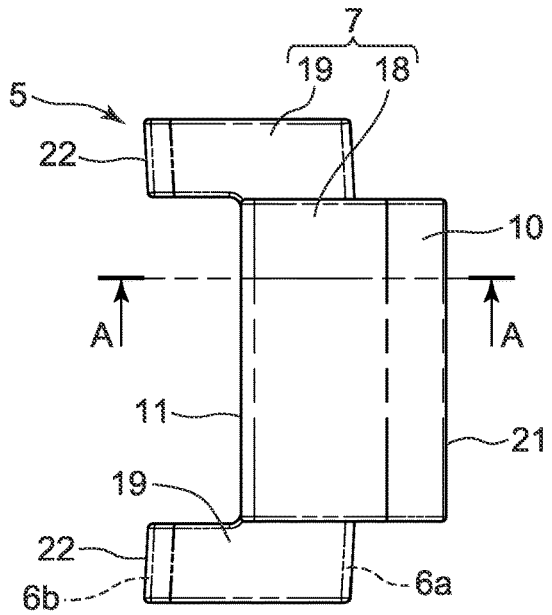
FIG. 3A is an enlarged front view showing a band piece of the watch band shown in FIG. 2A to FIG. 2C.
Figure 3B:
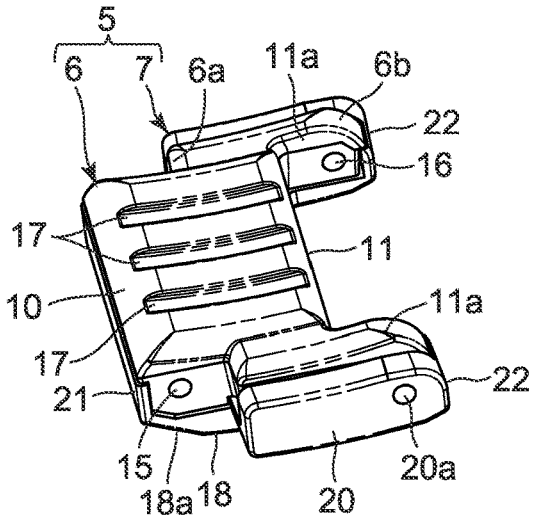
FIG. 3B is an enlarged perspective view showing the back surface side of the band piece of the watch band shown in FIG. 2A to FIG. 2C.
Figure 3C:
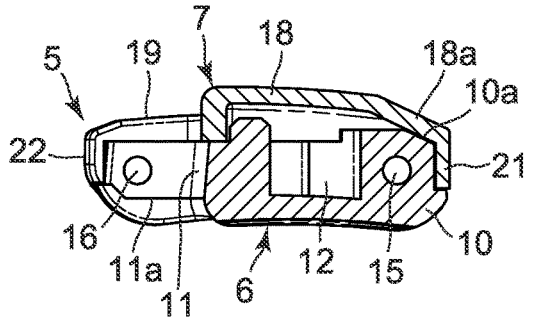
FIG. 3C is an enlarged sectional view of the band piece taken along line A-A shown in FIG. 3A.
Figure 4:
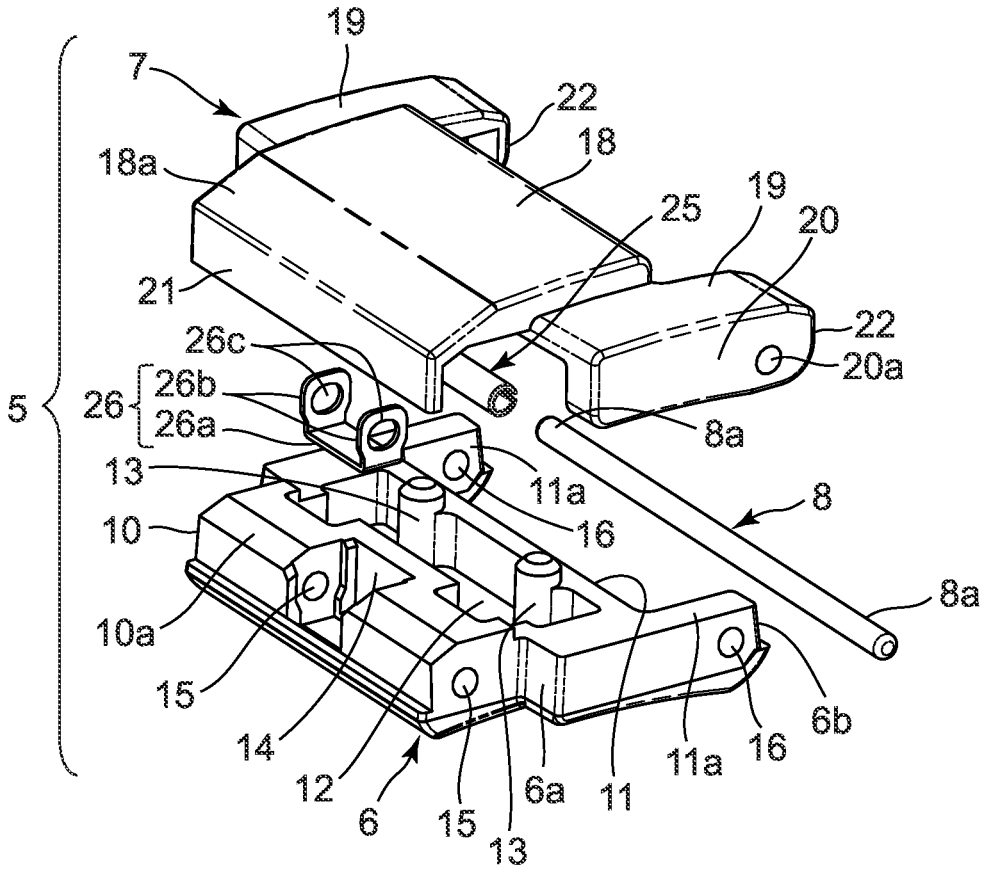
FIG. 4 is an enlarged perspective view showing the band piece of FIG. 3A to FIG. 3C in a disassembled state.

In this embodiment, the first front surface protection section 18 is formed to be raised one step higher toward the front side than the second front surface protection sections 19 located to the sides of the first front surface protection section 18, as shown in FIG. 3A, FIG. 3B. FIG. 3C and FIG. 4. When this first front surface protection section 18 covers the front surface of the first piece 6, the two support pillars 13 of the first piece 6 come in contact with the inner surface of the first front surface protection section 18, whereby the first front surface protection section 18 is supported.

Also, a portion of the first front surface protection section 18 corresponding to the inclined surface 10*a* of the projection section 10 of the first piece 6 is formed to decline toward the leading end side as an inclined surface 18*a*, as shown in FIG. 3A, FIG. 3B. FIG. 3C and FIG. 4. This inclined surface 18*a* of the first front surface protection section 18 has the same inclination angle as the inclined surface 10*a* of the projection section 10 of the first piece 6 and is arranged on this inclined surface 10*a* of the projection section 10. As a result, the second piece 7 is structured to be arranged on the first piece 6 while covering the entire front surface of the first piece 6 by the first front surface protection section 18 and the second front surface protection sections 19.

Also, the second piece 7 includes side surface protection sections 20 which cover and protect side surfaces of the side portions 11 located on the sides of the first piece 6 in the direction perpendicular to the piece connection direction, from the one end portion 6*a* of the first piece 6 to the other end portion 6*b*, as shown in FIG. 3A to FIG. 5. In the side surface protection sections 20, second connection holes 20*a* where the end portions 8*a* on both sides of the corresponding pin component 8 are inserted and attached are provided coaxially corresponding to the first connection holes 16 provided in both side portions 11*a* of the first piece 6.

Moreover, the second piece 7 includes a leading end protection section 21 which covers and protects the leading end surface of the projection section 10 of the first piece 6 when the entire front surface of the first piece 6 is covered by the first front surface protection section 18 and the second front surface protection sections 19, and other end protection sections 22 which cover and protect end surface portions of the other end portion 6*b* corresponding to the side portions 11*a* on the sides of the connection recess section 11 of the first piece 6, as shown in FIG. 3A to FIG. 5.

The leading end protection section 21 of the second piece 7 is structured to prevent the projection section 10 of the first piece 6 made of synthetic resin from being damaged when the corresponding watch band 2 having connected band pieces 5 is pulled in the piece connection direction, as shown in FIG. 2A, FIG. 2B, FIG. 2C and FIG. 7. Similarly, the other end protection sections 22 of the second piece 7 are structured to prevent the other end portion 6*b* of the first piece 6 made of synthetic resin being damaged at the side portions 11*a* on the sides of the connection recess section 11 when the corresponding watch band 2 having the connected band pieces 5 is pulled in the piece connection direction.

Also, on the inner surface of the second piece 7, the connection fixing section 23 is provided, as shown in FIG. 3A, FIG. 3B, FIG. 3C and FIG. 5. This connection fixing section 23 is provided on the inner surfaces of the first front surface protection section 18 and the leading end protection section 21 in a manner to be positioned in a middle area in the direction perpendicular to the piece connection direction. As a result, this connection fixing section 23 is structured to be arranged in the attachment recess section 14 in the projection section 10 of the first piece 6 when the second piece 7 is arranged on and covers the first piece 6.

In this connection fixing section 23, a pin insertion hole 24 into which the pin component 8 is inserted in the direction perpendicular to the piece connection direction is provided coaxially corresponding to the pin attachment holes 15 in the projection section 10 of the first piece 6, as shown in FIG. 3A, FIG. 3B, FIG. 3C and FIG. 5. This pin insertion hole 24 is formed such that its inner diameter is larger than the inner diameter of each pin attachment hole 15, that is, the outer diameter of the pin component 8. In this pin insertion hole 24, a fixing pipe 25 that is a fixing member such as a C ring is provided.

The fixing pipe 25 is structured to have a slit 25*a* in its outer circumferential portion along the axial direction, and is deformed to be stretched in radial directions, as shown in FIG. 5, FIG. 6A, FIG. 6B and FIG. 6C. More specifically, the fixing pipe 25 is formed such that its inner diameter is slightly smaller than the outer diameter of the pin component 8 and its outer diameter is substantially the same as the inner diameter of the pin insertion hole 24. In addition, the fixing pipe 25 is formed such that its length in the axial direction is substantially the same as or slightly shorter than the axial length of the pin insertion hole 24 of the connection fixing section 23.

Figure 5:
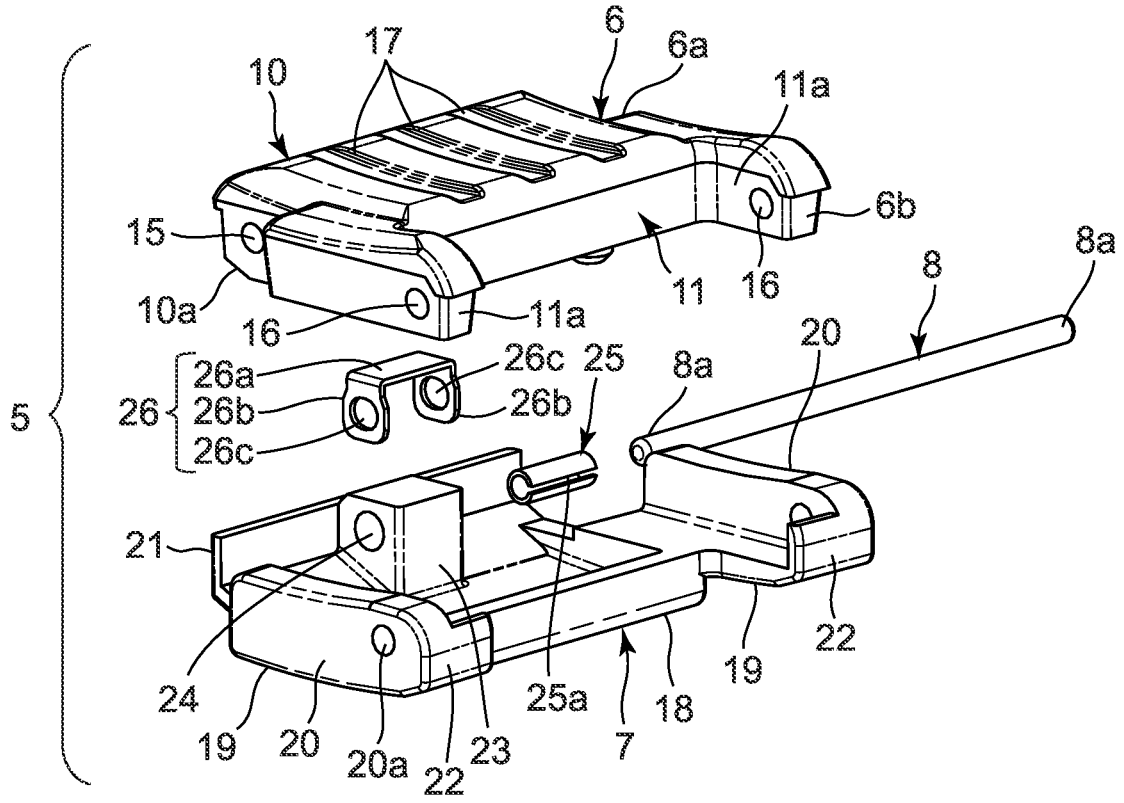
FIG. 5 is an enlarged perspective view of the band piece of FIG. 4 when viewed from the back surface side.
Figure 6A:
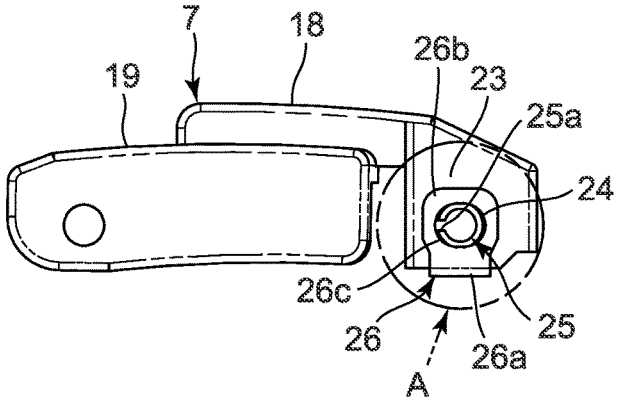
FIG. 6A is an enlarged side view of a side surface when a fixing pipe and a stopper member have been attached to a second piece of the band piece shown in FIG. 3A.
Figure 6B:
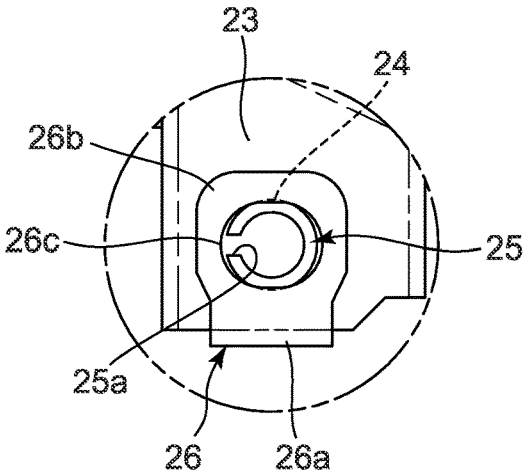
FIG. 6B is a further enlarged side view of an A portion shown in the enlarged side view of the side surface where the fixing pipe and the stopper member have been attached to the second piece of the band piece shown in FIG. 3A.
Figure 6C:
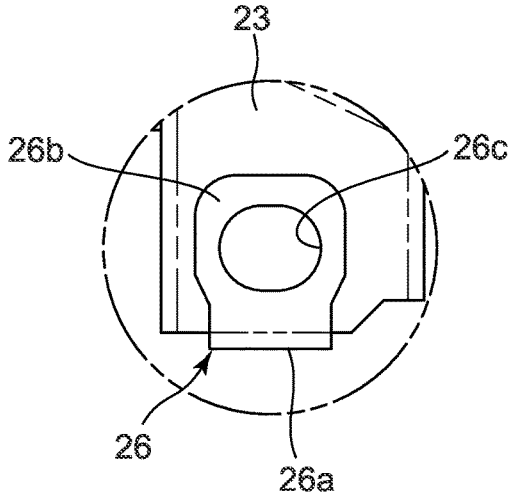
FIG. 6C is an enlarged view of a stopper hole in the stopper member shown in FIG. 6B.

As a result, the fixing pipe 25 is structured such that, when the pin component 8 is inserted into the fixing pipe 25 in the pin insertion hole 24 of the connection fixing section 23, the inner diameter of the fixing pipe 25 is widened by the pressure exerted by the pin component 8 and the outer circumferential surface of the fixing pipe 25 is pressed against the inner circumferential surface of the pin insertion hole 24 of the connection fixing section 23, whereby the pin component 8 is held and fixed in the pin insertion hole 24, as shown in FIG. 5. FIG. 6A. FIG. 6B and FIG. 6C.

In this embodiment, on the connection fixing section 23, a stopper member 26 is provided which prevents the fixing pipe 25 from slipping out of the pin insertion hole 24, as shown in FIG. 4 to FIG. 6C. This stopper member 26, which is formed by both side portions of a metal plate being bent, has a structure where an arrangement piece 26*a* in the middle of the metal plate is arranged on the back surface of the connection fixing section 23 and stopper pieces 26*b* on the sides of the metal plate are arranged on the side surfaces of the connection fixing section 23. The stopper pieces 26*b* have stopper holes 26*c* provided coaxially corresponding to the pin insertion hole 24.

Each stopper hole 26*c* of the stopper member 26 is formed such that its inner diameter is larger than the inner diameter of the fixing pipe 25, and smaller than the outer diameter of the fixing pipe 25, or in other words, the inner diameter of each pin insertion hole 24 of the connection fixing section 23, as shown in FIG. 6A to FIG. 6C. As a result, the stopper member 26 is structured such that, when the pin component 8 is being inserted into the fixing pipe 25 in the pin insertion hole 24 of the connection fixing section 23, the fixing pipe 25 does not slip out of the pin insertion hole 24 by an end of the fixing pipe 25 coming in contact with the rim of the corresponding stopper hole 26*c*.

Also, the stopper member 26 is formed such that the stopper holes 26*c* are long holes that are long in the piece connection direction, as shown in FIG. 6A to FIG. 6C. As a result, the stopper member 26 is structured such that the rims of the stopper holes 26*c* correspond to and come in contact with the ends of the fixing pipe 25 in the pin insertion hole 24 of the connection fixing section 23 even if the stopper holes 26*c* are at positions shifted in the piece connection direction when the stopper member 26 is arranged on the connection fixing section 23.

The second piece 7 is formed thinly by using a sintered metal acquired by the metal powder of stainless steel, titanium alloy, or the like being sintered. More specifically, the second piece 7 is formed by the metal powder of stainless steel, titanium alloy, or the like being mixed into a fluid resin by Metal Injection Molding (MIM), injected to fill a molding die, and subjected to sintering processing in this state to evaporate the resin and sinter the metal powder.

In this embodiment, the second piece 7 is formed such that the connection fixing section 23 is thick in order to ensure the strength of this connection fixing section 23 to which the pin component 8 is attached via the fixing pipe 25. However, the other sections of the second piece 7, such as the first front surface protection section 18, the second front surface protection sections 19, the side surface protecting sections 20, the leading end protection section 21, and the other end protection sections 22, are formed to be maximally thin, as shown in FIG. 5.

Next, the assembly of the watch band 2 is described. In the assembly of this watch band 2, first, each band piece 5 is assembled. Before this assembly, for each band piece 5, the second piece 7 is formed by sintering processing for sintering the metal powder of stainless steel, titanium alloy, or the like, and the first piece 6 is formed by injection molding of a synthetic resin such as urethane resin.

Then, the second piece 7 is arranged on and covers the first piece 6. Here, before this arrangement, the fixing pipe 25 is inserted into the pin insertion hole 24 provided in the connection fixing section 23 of the second piece 7. In addition, the stopper member 26 is arranged in the attachment recess section 14 of the first piece 6. Here, the stopper holes 26*c* of the stopper pieces 26*b* on the sides of the stopper member 26 are positioned coaxially corresponding to the pin attachment holes 15 provided in the projection section 10 of the first piece 6 and located to the sides of the attachment recess section 14.

In this state, when the second piece 7 is to be arranged on and cover the first piece 6, the connection fixing section 23 of the second piece 7 is arranged in the attachment recess section 14 of the first piece 6. As a result, the arrangement piece 26*a* in the middle of the stopper member 26 arranged in the attachment recess section 14 of the first piece 6 is arranged on the back surface of the connection fixing section 23, and the stopper pieces 26*b* on the sides of the stopper member 26 are arranged on the side surfaces of the connection fixing section 23.

Here, the stopper holes 26*c* of the stopper member 26 coaxially correspond to the pin insertion hole 24 of the connection fixing section 23, and this pin insertion hole 24 provided in the connection fixing section 23 of the second piece 7 coaxially corresponds to the pin attachment holes 15 provided to the sides of the attachment recess section 14 of the first piece 6.

In this embodiment, the stopper hole 26*c* of each stopper piece 26*b* is a long hole that is long in the piece connection direction. Accordingly, even if the stopper holes 26*c* are at positions shifted in the piece connection direction when the stopper member 26 is arranged on the connection fixing section 23, the rims of the stopper holes 26*c* are arranged corresponding to the ends of the fixing pipe 25 inserted into the pin insertion hole 24 of the connection fixing section 23.

Also, here, the first front surface protection section 18 of the second piece 7 is arranged on and covers the portion of the front surface of the first piece 6 from the projection section 10 to the connection recess section 11 and supported by the two support pillars 13 of the first piece 6, and the inclined surface 18*a* of the first front surface protection section 18 is arranged on the inclined surface 10*a* of the first piece 6. In addition, the second front surface protection sections 19 of the second piece 7 are arranged on and cover the portions of the front surface of the first piece 6 corresponding to the side portions 11*a* located on the sides of the connection recess section 11 in the direction perpendicular to the piece connection direction, from the one end portion 6*a* to the other end portion 6*b*.

Similarly, the side surface protection sections 20 of the second piece 7 are arranged on and cover the side surfaces of the side portions 11 located on the sides of the first piece 6, and the second connection holes 20*a* of the side surface protection sections 20 coaxially correspond to the first connection holes 16 of the side portions 11*a* on the sides of the first piece 6. In addition, the leading end protection section 21 of the second piece 7 is arranged on and covers the leading end surface of the projection section 10 of the first piece 6, and the other end protection sections 22 of the second piece 7 are arranged on and cover the end surface portions of the other end portion 6*b* corresponding to the side portions 11*a* on the sides of the connection recess section 11 of the first piece 6.

As a result, by the second piece 7 made of metal, the first piece 6 made of synthetic resin is covered and protected except for its back surface side. In this state, the above-described pin component 8 is inserted into the fixing pipe 25 arranged in the pin insertion hole 24 of the connection fixing section 23, whereby the first piece 6 and the second piece 7 are connected to each other. By this assembly work being repeated, each band piece 5 is assembled.

Figure 7:
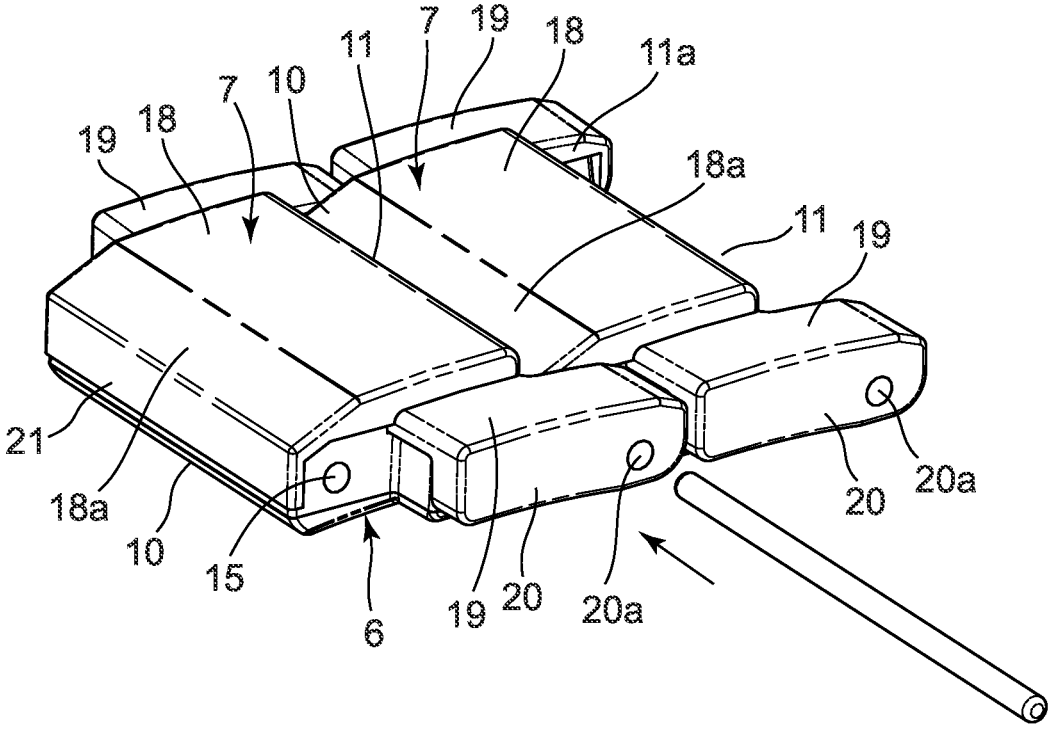
FIG. 7 is an enlarged perspective view showing a state where band pieces such as that shown in FIG. 3A to FIG. 3C are being connected to each other.

In this embodiment, a portion of one band piece 5 corresponding to the projection section 10 of its first piece 6 is arranged in a portion of an adjacent band piece 5 corresponding to the connection recess section 11 of its first piece 6, as shown in FIG. 7. More specifically, the projection section 10 of the first piece 6 of this band piece 5 and the first front surface protection section 18 of the second piece 7 corresponding to this projection section 10 are arranged in the connection recess section 11 of the first piece 6 of the adjacent band piece 5 and between the second front surface protection sections 19 of the second piece 7 corresponding to this connection recess section 11.

Here, the pin attachment holes 15 in the projection section 10 on the first piece 6 of the band piece 5 coaxially correspond to the first connection holes 16 in the side portions 11*a* on the sides of the connection recess section 11 of the first piece 6 of the adjacent band piece 5 and to the second connection holes 20*a* in the side surface protection sections 20 of the second piece 7 of the adjacent band piece 5.

In this state, a pin component 8 is inserted from one side of the band pieces 5 into one of the second connection holes 20*a* in the side surface protection sections 20 of the second piece 7 of the adjacent band piece 5 and one of the first connection holes 16 in the side portions 11*a* of the first piece 6 corresponding to this second connection hole 20*a*. Subsequently, the pin component 8 is inserted into one of the pin attachment holes 15 in the first piece 6 of the band piece 5, inserted into one of the stopper holes 26*c* in the stopper member 26, and then inserted into the fixing pipe 25 in the pin insertion hole 24 provided in the connection fixing section 23 of the second piece 7.

Here, the pin component 8 inserted into the fixing pipe 25 widens the inner diameter of the fixing pipe 25 by its pressure and thereby presses the outer circumferential surface of the fixing pipe 25 against the inner circumferential surface of the pin insertion hole 24 of the connection fixing section 23. As a result, the pin component 8 is held and fixed in the pin insertion hole 24 of the connection fixing section 23 by the fixing pipe 25.

In this embodiment, by the rims of the stopper holes 26*c* provided in the stopper pieces 26*b* of the stopper member 26 and arranged to the sides of the connection fixing section 23, the fixing pipe 25 is prevented from slipping out of the pin insertion hole 24 when the pin component 8 is inserted into the fixed pipe 25. That is, each stopper hole 26*c* of the stopper member 26 is formed such that its inner diameter is larger than the inner diameter of the fixing pipe 25, and smaller than the outer diameter of the fixing pipe 25, or in other words, the inner diameter of the pin insertion hole 24 of the connection fixing section 23.

Accordingly, when the pin component 8 is inserted into the fixing pipe 25 and the fixing pipe 25 is pressed in the axial direction by the pin component 8, an end of the fixing pipe 25 comes in contact with the rim of the corresponding stopper hole 26*c* of the stopper member 26. As a result of this structure, the pin component 8 is inserted into the fixing pipe 25 without the fixing pipe 25 slipping out of the pin insertion hole 24.

Then, when the pin component 8 is further pressed into the fixing pipe 25, the end portion 8*a* of the pin component 8 on the leading end side is inserted into the other pin attachment hole 15 of the first piece 6 of the band piece 5, and then inserted into the first connection hole 16 in the other side portion 11*a* of the first piece 6 of the adjacent band piece 5 and the second connection hole 20*a* in the other side protection section 20 of the second piece 7 of the adjacent band piece 5.

As a result, the first piece 6 and the second piece 7 are connected by the pin component 8, whereby the one band piece 5 is assembled and, at the same time, this band piece 5 and the adjacent band piece 5 are connected to each other. That is, in this band piece 5, the projection section 10 of the first piece 6 and the connection fixing section 23 of the second piece 7 are connected by the pin component 8. In addition, in the adjacent band piece 5, the side portions 11*a* on the sides of the connection recess section 11 of the first piece 6 and the side surface protection sections 20 of the second piece 7 are connected to each other by the same pin component 8.

That is, the end portions of the first piece 6 and the second piece 7 of this band piece 5 on the one end portion 6*a* side of the first piece 6 and the end portions of the first piece 6 and the second piece 7 of the adjacent band piece 5 on the other end portion 6*b* side of the first piece 6 are connected by the one pin component 8, whereby these band pieces 5 adjacent to each other are connected. By the above-described connection of adjacent band pieces 5 by a pin component 8 being sequentially performed, each watch band 2 is assembled.

In this watch band 2 assembled as described above, the first pieces 6 made of synthetic resin are covered by the metal second pieces 7 except for their back surface sides. Accordingly, this watch band 2 gives an impression of being entirely made of metal when seen from the front surface side, and thereby gives a sophisticated feeling. Also, even when band pieces 5 of this watch band 2 are subjected to an external impact, the metal second pieces 7 reliably and favorably protect the first pieces 6 from being damaged or broken by this impact.

Also, each second piece 7 of this watch band 2 is thinly formed by using a sintered metal acquired by the metal powder of stainless steel, titanium alloy, or the like being sintered. That is, in each band piece 5, although the connection fixing section 23 to which a pin component 8 is attached via the fixing pipe 25 is thickly formed in order to ensure its strength, the other sections, such as the first front surface protection section 18, the second front surface protection sections 19, the side surface protecting sections 20, the leading end protection section 21, and the other end protection sections 22, are formed to be maximally thin. As a result, the weight saving of each band piece 5 is achieved.

As such, each band piece 5 of this watch band 2 includes the first piece 6 having the projection section 10 provided projecting from the one end portion 6*a* in the piece connection direction and the connection recess section 11 provided in the other end portion 6*b* located on the side opposite to the one end portion 6*a* such that the projection section 10 of an adjacent band piece 5 can be arranged, the second piece 7 which covers the first piece 6 except for one (the back surface side in the present embodiment) of the front and back surface sides thereof, and the pin component 8 which connects the first piece 6 and the second piece 7 and also connects the band piece 5 and the adjacent band piece 5. By these components, the structure can be simplified and the weight can be lightened.

That is, each band piece 5 of this watch band 2 is structured such that the second piece 7 arranged on the first piece 6 can cover the first piece 6 except for the back surface side thereof, and the first piece 6 and the second piece 7 can be connected to each other in this state by the pin component 8. As a result, the number of the parts can be decreased, the structure can be simplified, and the assembly can be easily performed. In addition, by the structure where only the second piece 7 is made of metal, the weight saving of the band piece 5 can be achieved while achieving a high-class design.

In the case of the band piece 5 of this watch band 2, when the first piece 6 and the second piece 7 are to be connected to each other by the pin component 8, the portion of the first piece 6 corresponding to the projection section 10 is arranged in the portion of the adjacent band piece 5 corresponding to the connection recess section 11 of the first piece 6 thereof. In this state, the band piece 5 and the adjacent band piece are connected to each other by the pin component 8 and, at the same, the first piece 6 and the second piece 7 are connected to each other to constitute the band piece 5. Accordingly, with this band piece 5, the number of the parts can be further decreased and the structure can be further simplified.

Also, in the case of the band piece 5 of this watch band 2, the first piece 6 is made of a synthetic resin such as urethane resin, and the second piece 7 is made of a metal such as stainless steel or titanium alloy. Accordingly, the first piece 6 can be covered and protected by the second piece 7 except for its back surface side, and weight saving can be achieved by the first piece 6 made of a synthetic resin such as urethane resin.

In the band piece 5 of this watch band 2, even though the first piece 6 is made of a synthetic resin such as urethane resin, this first piece 6 can be reliably and favorably protected by the second piece 7 from being damaged or broken by external impacts exerted on the band piece 5, since the second piece 7 made of a metal such as stainless steel or titanium alloy is arranged on the band piece 5. In addition, by the second piece 7, a sophisticated feeling can be provided.

Also, in the band piece 5 of this watch band 2, the second piece 7 includes the connection fixing section 23 having the pin insertion hole 24 which is provided in the direction perpendicular to the piece connection direction and into which the pin component 8 is inserted, and the first piece 6 includes the attachment recess section 14 where the connection fixing section 23 is arranged and the pin attachment holes 15 which are provided to the sides of the attachment recess section 14 in a manner to coaxially correspond to the pin insertion hole 24 and into which the side parts of the pin component 8 are inserted. As a result, the first piece 6 and the second piece 7 can be easily connected to each other by the pin component 8.

That is, in the case of the band piece 5 of this watch band 2, when the second piece 7 covers the first piece 6, the connection fixing section 23 of the second piece 7 is mounted in the attachment recess section 14 of the first piece 6, and the pin insertion hole 24 of the mounted connection fixing section 23 coaxially corresponds to the pin attachment holes 15 provided to the sides of the attachment recess section 14. Therefore, the pin component 8 can be inserted from one of the pin attachment holes 15 into the pin insertion hole 24 of the connection fixing section 23 and into the other pin attachment hole 15, whereby the first piece 6 and the second piece 7 can be easily and unfailingly connected to each other by the pin component 8.

In the case of this band piece 5, the attachment recess section 14 and the pin attachment holes 15 for the first piece 6 are provided in the projection section 10 of the first piece 6, the connection fixing section 23 of the second piece 7 is provided corresponding to the attachment recess section 14 in the projection section 10 of the first piece 6, and the first connection holes 16 and the second connection holes 20*a* where the end portions 8*a* on the sides of the pin component 8 are inserted and attached are provided in the side portions 11*a* on the sides of the connection recess section 11 of the first piece 6 and the side surface protection sections 20 of the second piece 7 for covering the side portions 11*a*, and coaxially correspond to the pin attachment holes 15 of an adjacent band piece 5. As a result, these adjacent band pieces 5 can be connected to each other by the pin component 8.

That is, in the case of this band piece 5, when the first piece 6 and the second piece 7 are to be connected to each other by the pin component 8, the pin component 8 can be inserted into the second connection holes 20*a* in the second piece 7 of an adjacent band piece 5, the first connection holes 16 in the first piece 6 of this adjacent band piece 5, the pin attachment holes 15 in the first piece of the own band piece 5, and the pin insertion hole 24 in the connection fixing section 23 of the own band piece 5 with the projection section 10 of the own band piece 5 being arranged in the connection recess section 11 of the adjacent band piece 5, whereby the first piece 6 and the second piece 7 can be connected to each other by the one pin component 8 and, at the same time, the adjacent band pieces 5 can be connected to each other.

Also, the band piece 5 of this watch band 2 includes the fixing pipe 25 which is a fixing member for holding and fixing the pin component 8 in the pin insertion hole 24 in the connection fixing section 23 of the second piece 7. By this fixing pipe 25, the pin component 8 can be reliably and favorably held and fixed in the pin insertion hole 24 of the connection fixing section 23.

That is, in the case of the band piece 5 of this watch band 2, the fixing pipe 25 is structured to have the slit 25*a* on its outer circumferential portion along the axial direction and to be deformed to be stretched in radial directions, and its inner diameter is slightly smaller than the outer diameter of the pin component 8. Accordingly, when the pin component 8 is inserted into the fixing pipe 25 arranged in the pin insertion hole 24 of the connection fixing section 23, the inner diameter of the fixing pipe 25 is widened by the pressure exerted by the pin component 8 and the outer circumferential surface of the fixing pipe 25 is pressed against the inner circumferential surface of the pin insertion hole 24. As a result, by the fixing pipe 25, the pin component 8 can be reliably and favorably held and fixed in the pin insertion hole 24.

Moreover, the band piece 5 of this watch band 2 includes the stopper member 26 which prevents the fixing pipe 25 from slipping out of the pin insertion hole 24. Accordingly, by this stopper member 26, the fixing pipe 25 can be reliably and favorably prevented from slipping out of the pin insertion hole 24 by the insertion of the pin component 8 when the pin component 8 is inserted into the fixing pipe 25 arranged in the pin insertion hole 24.

That is, in the case of the band piece 5 of this watch band 2, the stopper member 26 includes the arrangement piece 26*a* which is arranged on the back surface of the connection fixing section 23 and the stopper pieces 26*b* on both sides which are arranged on the side surfaces of the connection fixing section 23. In the stopper pieces 26*b*, the stopper holes 26*c* have been provided, and the inner diameter of each stopper hole 26*c* is larger than the inner diameter of the fixing pipe 25 and smaller than the outer diameter of the fixing pipe 25. As a result, an end of the fixing pipe 25 unfailingly comes in contact with the rim of the corresponding stopper hole 26*c*, whereby the fixing pipe 25 can be reliably and favorably prevented from slipping out of the pin insertion hole 24.

In the case of the band piece 5 of this watch band 2, the stopper holes 26*c* in the stopper pieces 26*b* of the stopper member 26 are formed to be long holes that are long in the piece connection direction. As a result, the rims of the stopper holes 26*c* unfailingly and favorably correspond to the ends of the fixing pipe 25 inserted into the pin insertion hole 24 of the connection fixing section 23 even if the stopper holes 26*c* are at positions shifted in the piece connection direction when the stopper member 26 is arranged on the connection fixing section 23.

Also, in the case of the band piece 5 of this watch band 2, the second piece 7 includes the leading end protection section 21 and the other end protection sections 22 serving as protection sections for protecting the leading end surface of the projection section 10 on the one end portion 6*a* side, which is an end surface of the first piece 6 in the piece connection direction, and protecting the end surface portions of the other end portion 6*b*. As a result, by the leading end protection section 21 and the other end protection sections 22, the projection section 10 of the first piece 6 made of synthetic resin and the other end portion 6*b* corresponding to the side portions 11*a* on the sides of the connection recess section 11 can be reliably and favorably prevented from being damaged when the corresponding watch band 2 having connected band pieces 5 is pulled in the piece connection direction.

Moreover, in the case of the band piece 5 of this watch band 2, the second piece 7 includes the side surface protection sections 20 serving as protection sections for protecting the side surfaces of the first piece 6 from the one end portion 6*a* to the other end portion 6*b* in the piece connection direction. As a result, even when the side surfaces of the band piece 5 are subjected to impacts, the side surfaces of the first piece 6 are reliably and favorably protected by the side surface protection sections 20 of the second piece 7 from being damaged or broken by the impacts.

Furthermore, in the case of the band piece 5 of this watch band 2, the second piece 7 is thinly formed by using a sintered metal acquired by the metal powder of stainless steel, titanium alloy, or the like being sintered. That is, the second piece 7 is formed by the metal powder of stainless steel, titanium alloy, or the like being mixed into a fluid resin by Metal Injection Molding (MIM), injected to fill a molding die, and subjected to sintering processing in this state to evaporate the resin and sinter the metal powder. Therefore, even though the shape of the second piece 7 is complicated, this thin second piece 7 can be easily manufactured.

Accordingly, in the case of the band piece 5 of this watch band 2, even though the connection fixing section 23 of the second piece 7 to which the pin component 8 is attached via the fixing pipe 25 is thickly formed in order to ensure the strength of this connection fixing section 23, the other sections such as the first front surface protection section 18, the second front surface protection sections 19, the side surface protecting sections 20, the leading end protection section 21, and the other end protection sections 22 can be formed to be maximally thin, whereby the weight saving of the band piece 5 can be achieved.

Also, according to this watch band 2, a plurality of band pieces 5 can be serially connected to one another by the projection section 10 of each band piece 5 being arranged in the connection recess section 11 of an adjacent band piece 5 and adjacent band pieces 5 being connected by a pin component 8, whereby the structure can be simplified and the weight saving can be achieved.

That is, in the case of this watch band 2, when the first piece 6 and second piece 7 of a band piece 5 are to be connected by a pin component 8 with the second piece 7 being arranged on and covering the first piece 6, the projection section 10 of the band piece 5 is arranged in the connection recess section 11 of an adjacent band piece 5, and these adjacent band pieces 5 are connected to each other in this state by the one pin component 8. As a result of this structure, the assembly work for assembling a band piece 5 by connecting a first piece 6 and a second piece 7 and the connecting work for connecting adjacent band pieces 5 can be performed simultaneously.

Thus, according to this watch band 2, the number of parts can be decreased and assembly work can be simplified. In addition, each metal second piece 7 which covers a first piece 6 made of synthetic resin can be thinly formed, so that weight saving can be achieved, and a sophisticated feeling can be provided since the entire watch band 2 shows a metallic appearance by the metal second pieces 7.

In the above-described embodiment, each pin component 8 is formed in the stick shape. However, the present invention is not limited thereto and the pin component 8 may have the same structure as the fixing pipe 25. More specifically, the pin component 8 may be a pipe which has a C-shaped cross section and in which a slit has been provided along its axial direction.

With this pipe-shaped pin component, no fixing pipe 25 is required to be provided in the pin insertion hole 24 of the connection fixing section 23. That is, this pin component can be directly inserted into the pin insertion hole 24 and held and fixed by being contracted and deformed in radial directions. By this structure, the stopper member 26 also becomes unnecessary and the number of the parts can be further decreased.

Also, in the above-described embodiment, the first piece 6 is made of synthetic resin and the second piece 7 is made of metal. However, the first piece 6 and the second piece 7 may be made of other materials.

Moreover, in the above-described embodiment, the present invention has been applied in a watch band of a wristwatch. However, the present invention is not necessarily required to be applied in a watch band of a wristwatch and may be applied in, for example, a band of a bracelet or a handbag.

While the present invention has been described with reference to the preferred embodiments, it is intended that the invention be not limited by any of the details of the description therein but includes all the embodiments which fall within the scope of the appended claims.

What is claimed is:

1. A band piece comprising:

a first piece which is formed of synthetic resin;

a second piece which is formed of metal and which covers a front surface side of the first piece; and a pin which connects the first piece and the second piece and connects the band piece and another band piece, wherein the second piece includes a connection fixing projection having an insertion hole which is provided in a direction perpendicular to a piece connection direction and into which the pin is inserted, and wherein the first piece includes an attachment recess where the connection fixing projection is arranged, and attachment holes which are provided to sides of the attachment recess so as to coaxially correspond to the insertion hole and into which sides of the pin are inserted.

2. The band piece according to claim 1, wherein the attachment recess and the attachment holes of the first piece are provided in a projection provided projecting in the piece connection direction of the first piece, wherein the connection fixing projection of the second piece is provided corresponding to the attachment recess provided in the projection of the first piece, and wherein sides of a connection recess provided on a side opposite to the projection of the first piece and sides of the second piece which cover the sides of the first piece have first connection holes and second connection holes which are provided coaxially corresponding to one another and into which ends of the pin are inserted to be attached.

3. The band piece according to claim 2, further comprising:

a fixing member which fixes the pin in the insertion hole in the connection fixing projection of the second piece.

4. The band piece according to claim 3, further comprising:

a stopper member which prevents the fixing member from slipping out of the insertion hole.

5. The band piece according to claim 1, further comprising:

a fixing member which fixes the pin in the insertion hole in the connection fixing projection of the second piece.

6. The band piece according to claim 5, further comprising:

a stopper member which prevents the fixing member from slipping out of the insertion hole.

7. The band piece according to claim 1, wherein the second piece includes a protection surface which protects an end surface of the first piece in the piece connection direction.

8. The band piece according to claim 1, wherein the second piece is formed of a sintered metal acquired by metal powder being sintered.

9. A band comprising:

a plurality of band pieces each comprising the band piece recited in claim 1, the plurality of band pieces being connected in series, wherein a projection provided on the first piece of one of the plurality of band pieces and projecting in a piece connection direction is arranged in a connection recess provided on a side opposite to a projection provided on the first piece of another of the plurality of band pieces adjacent to the one of the plurality gf band pieces and projecting in the piece connection direction, and wherein the one of the plurality of band pieces and the another of the plurality of band pieces are connected to each other by a pin.

10. A timepiece comprising the band according to claim 9.

11. A band piece comprising:

a first piece;

a second piece which covers a front surface side of the first piece; and a pin which connects the first piece and the second piece and connects the band piece and another band piece, wherein the second piece includes a connection fixing projection having an insertion hole which is provided in a direction perpendicular to a piece connection direction and into which the pin is inserted, wherein the first piece includes an attachment recess where the connection fixing projection is arranged, and attachment holes which are provided to sides of the attachment recess so as to coaxially correspond to the insertion hole and into which sides of the pin are inserted, wherein the attachment recess and the attachment holes of the first piece are provided in a projection provided projecting in the piece connection direction of the first piece, wherein the connection fixing projection of the second piece is provided corresponding to the attachment recess provided in the projection of the first piece, and wherein sides of a connection recess provided on a side opposite to the projection of the first piece and sides of the second piece which cover the sides of the first piece have first connection holes and second connection holes which are provided coaxially corresponding to one another and into which ends of the pin are inserted to be attached.

12. The band piece according to claim 11, wherein the first piece is formed of synthetic resin and the second piece is formed of metal.

13. The band piece according to claim 12, further comprising:

a stopper member which prevents the fixing member from slipping out of the insertion hole.

14. The band piece according to claim 11, further comprising:

a fixing member which fixes the pin in the insertion hole in the connection fixing projection of the second piece.

15. The band piece according to claim 11, wherein the second piece includes a protection surface which protects an end surface of the first piece in the piece connection direction.

16. The band piece according to claim 11, wherein the second piece is formed of a sintered metal acquired by metal powder being sintered.

17. A band piece comprising:

a first piece;

a second piece which covers a front surface side of the first piece;

a pin which connects the first piece and the second piece and connects the band piece and another band piece;

a fixing member; and a stopper member, wherein the second piece includes a connection fixing projection having an insertion hole which is provided in a direction perpendicular to a piece connection direction and into which the pin is inserted, wherein the first piece includes an attachment recess where the connection fixing projection is arranged, and attachment holes which are provided to sides of the attachment recess so as to coaxially correspond to the insertion hole and into which sides of the pin are inserted, wherein the fixing member fixes the pin in the insertion hole in the connection fixing projection of the second piece, and wherein the stopper member prevents the fixing member from slipping out of the insertion hole.

18. The band piece according to claim 17, wherein the first piece is formed of synthetic resin and the second piece is formed of metal.

19. The band piece according to claim 17, wherein the second piece includes a protection surface which protects an end surface of the first piece in the piece connection direction.

20. The band piece according to claim 17, wherein the second piece is formed of a sintered metal acquired by metal powder being sintered.

* * * * *